US010526689B2

(12) United States Patent
Koyanagi et al.

(10) Patent No.: US 10,526,689 B2
(45) Date of Patent: Jan. 7, 2020

(54) HEAT-RESISTANT TI ALLOY AND PROCESS FOR PRODUCING THE SAME

(71) Applicant: DAIDO STEEL CO., LTD., Nagoya-shi (JP)

(72) Inventors: Yoshihiko Koyanagi, Nagoya (JP); Takuma Okajima, Nagoya (JP)

(73) Assignee: DAIDO STEEL CO., LTD., Nagoya-Shi, Aichi (JP)

( * ) Notice: Subject to any disclaimer, the term of this patent is extended or adjusted under 35 U.S.C. 154(b) by 213 days.

(21) Appl. No.: 15/836,574

(22) Filed: Dec. 8, 2017

(65) Prior Publication Data

US 2018/0171457 A1 Jun. 21, 2018

(30) Foreign Application Priority Data

Dec. 15, 2016 (JP) ..... 2016-243851

(51) Int. Cl.

| | |
|---|---|
| ***C22F 1/18*** | (2006.01) |
| ***C22C 14/00*** | (2006.01) |
| *B21J 1/02* | (2006.01) |
| *B21J 1/06* | (2006.01) |

(52) U.S. Cl.

CPC ..... *C22F 1/183* (2013.01); *C22C 14/00* (2013.01); *B21J 1/025* (2013.01); *B21J 1/06* (2013.01)

(58) Field of Classification Search

CPC ..... C22F 1/183; C22C 14/00

See application file for complete search history.

(56) References Cited

U.S. PATENT DOCUMENTS

| | | | |
|---|---|---|---|
| 5,922,274 | A | 7/1999 | Suzuki et al. |
| 6,284,071 | B1 | 9/2001 | Suzuki et al. |
| 8,613,818 | B2 | 12/2013 | Forbes Jones et al. |
| 9,206,497 | B2 | 12/2015 | Bryan et al. |
| 9,624,567 | B2 | 4/2017 | Bryan et al. |
| 2012/0060981 | A1 | 3/2012 | Forbes Jones et al. |
| 2013/0118653 | A1 | 5/2013 | Bryan et al. |
| 2014/0076471 | A1 | 3/2014 | Forbes Jones et al. |
| 2016/0047024 | A1 | 2/2016 | Bryan et al. |

FOREIGN PATENT DOCUMENTS

| | | | |
|---|---|---|---|
| JP | H 10-195563 | A | 7/1998 |
| JP | 2016-503126 | A | 2/2016 |
| WO | WO 2014/093009 | A | 6/2014 |

OTHER PUBLICATIONS

Extended European Search Report dated Jan. 25, 2018 in European Application No. 17206742.3.

Noda T et al: "Development of High Performance Heat Resistant Near-Alpha Titanium Alloy Compressor Disk", Titanium Science and Technology, XX, XX, Jan. 1, 1995 (Jan. 1, 1995), pp. 2258-2264.

Akihiro Suzuki et al: "Effect of Microstructures on Mechanical Properties of Heat Resistant Titanium Alloys at Elevated Temperatures", Journal of Metastable and Nanocrystalline Materials, vol. 426-432, Jan. 1, 2003 (Jan. 1, 2003), pp. 667-672.

*Primary Examiner* — Jessee R Roe

(74) *Attorney, Agent, or Firm* — McGinn IP Law Group, PLLC

(57) ABSTRACT

The present invention relates to a heat-resistant Ti alloy having excellent high-temperature strength and a process for producing the same. More particularly, the present invention relates to a heat-resistant Ti alloy having a composite structure having an equiaxed α phase and β grains containing an acicular α phase inside thereof, and a process for producing the same.

18 Claims, 6 Drawing Sheets

*Fig. 3*

| | Chemical components (% by mass) | | | | | | | | | | | | | | β transformation point |
|---|---|---|---|---|---|---|---|---|---|---|---|---|---|---|---|
| | Al | Sn | Zr | Mo | Nb | Ta | Si | C | O | N | B | Fe | Ti | Other | |
| Example 1 | 5.83 | 4.08 | 3.48 | 2.81 | 0.68 | - | 0.34 | 0.07 | 0.11 | 0.08 | - | 0.10 | bal. | - | 1035°C |
| Example 2 | 5.79 | 4.02 | 3.52 | 2.89 | 0.47 | 0.21 | 0.35 | 0.06 | 0.12 | 0.09 | - | 0.14 | bal. | - | 1035°C |
| Example 3 | 5.80 | 3.99 | 3.61 | 2.78 | 0.69 | - | 0.36 | 0.07 | 0.13 | 0.10 | - | 0.13 | bal. | - | 1035°C |
| Example 4 | 5.78 | 4.01 | 3.47 | 2.81 | 0.71 | - | 0.33 | 0.06 | 0.11 | 0.09 | 0.01 | 0.13 | bal. | - | 1035°C |
| Example 5 | 5.81 | 4.10 | 3.56 | 2.69 | 0.69 | - | 0.35 | 0.07 | 0.12 | 0.08 | - | 0.10 | bal. | - | 1035°C |
| Example 6 | 5.82 | 3.97 | 3.48 | 2.88 | 0.67 | - | 0.36 | 0.06 | 0.10 | 0.09 | - | 0.08 | bal. | - | 1035°C |
| Example 7 | 5.82 | 3.97 | 3.48 | 2.78 | 0.67 | - | 0.36 | 0.06 | 0.10 | 0.09 | - | 0.08 | bal. | - | 1035°C |
| Example 8 | 5.81 | 4.05 | 3.47 | 2.71 | 0.68 | - | 0.35 | 0.06 | 0.12 | 0.09 | - | 0.09 | bal. | - | 1035°C |
| Example 9 | 5.78 | 3.99 | 3.46 | 2.70 | 0.68 | - | 0.35 | 0.06 | 0.13 | 0.10 | - | 0.10 | bal. | - | 1035°C |
| Example 10 | 5.79 | 4.04 | 3.51 | 2.77 | 0.71 | - | 0.36 | 0.06 | 0.11 | 0.12 | - | 0.09 | bal. | - | 1035°C |
| Comparative Example 1 | 6.01 | - | - | - | - | - | - | - | - | - | - | 0.15 | bal. | V:4.0 | 995°C |
| Comparative Example 2 | 5.81 | 4.00 | 3.49 | 2.76 | 0.65 | - | 0.35 | 0.07 | 0.13 | 0.08 | - | 0.12 | bal. | - | 1035°C |
| Comparative Example 3 | 5.78 | 3.99 | 3.48 | 2.82 | 0.68 | - | 0.34 | 0.08 | 0.12 | 0.07 | - | 0.15 | bal. | - | 1035°C |
| Comparative Example 4 | 5.89 | 4.02 | 3.57 | 2.79 | 0.67 | - | 0.37 | 0.06 | 0.10 | 0.08 | - | 0.13 | bal. | - | 1035°C |
| Comparative Example 5 | 5.76 | 4.10 | 3.62 | 2.68 | 0.66 | - | 0.36 | 0.07 | 0.12 | 0.09 | - | 0.15 | bal. | - | 1035°C |
| Comparative Example 6 | 5.82 | 4.02 | 3.57 | 2.77 | 0.71 | - | 0.35 | 0.08 | 0.11 | 0.08 | - | 0.14 | bal. | - | 1035°C |
| Comparative Example 7 | 5.76 | 3.99 | 3.48 | 2.79 | 0.70 | - | 0.35 | 0.07 | 0.15 | 0.09 | - | 0.12 | bal. | - | 1035°C |
| Comparative Example 8 | 5.78 | 3.98 | 3.51 | 2.81 | 0.68 | - | 0.35 | 0.06 | 0.12 | 0.09 | - | 0.13 | bal. | - | 1035°C |
| Comparative Example 9 | 5.81 | 4.02 | 3.50 | 2.80 | 0.72 | - | 0.35 | 0.07 | 0.11 | 0.10 | - | 0.09 | bal. | - | 1035°C |

*Fig. 4*

| Step | Pre-forging | First heat treatment | α+β forging (adjustment) | | | α+β forging (upsetting) | | | Second heat treatment | Aging heat treatment |
|---|---|---|---|---|---|---|---|---|---|---|
| | Forming ratio | Holding temperature/ cooling conditions | Forging temperature | Strain rate (/sec) | Forming ratio | Forging temperature | Strain rate (/sec) | Forming ratio | Holding temperature/ cooling conditions | Holding temperature/ cooling conditions |
| Example 1 | 4.0 | 1060°C/AC | 960°C | 0.1 | 3.0 | - | - | - | 1000°C/AC | 635°C/AC |
| Example 2 | 4.0 | 1060°C/AC | 960°C | 1.7 | 3.0 | - | - | - | 1010°C/AC | 635°C/AC |
| Example 3 | 4.0 | 1060°C/AC | 960°C | 1.2 | 3.0 | - | - | - | 980°C/AC | 635°C/AC |
| Example 4 | 4.0 | 1060°C/AC | 960°C | 2.6 | 3.0 | - | - | - | 1000°C/AC | 635°C/AC |
| Example 5 | 4.0 | 1060°C/AC | 960°C | 0.8 | 3.0 | - | - | - | 1000°C/AC | 635°C/AC |
| Example 6 | 4.0 | 1060°C/AC | 960°C | 0.8 | 3.0 | 960°C | 5.9 | 3.0 | 1000°C/AC | 635°C/AC |
| Example 7 | 4.0 | 1060°C/AC | 960°C | 4.8 | 3.0 | - | - | - | 1000°C/AC | 635°C/AC |
| Example 8 | 4.0 | 1060°C/AC | 960°C | 8.2 | 3.0 | - | - | - | 1000°C/AC | 635°C/AC |
| Example 9 | 4.0 | 1060°C/AC | 960°C | 0.8 | 6.0 | - | - | - | 1000°C/AC | 635°C/AC |
| Example 10 | 4.0 | 1060°C/AC | 960°C | 0.8 | 8.0 | | | | 1000°C/AC | 635°C/AC |
| Comp. Ex. 1 | 4.0 | 1030°C-AC | 900°C | 0.8 | 3.0 | 900°C | 6.5 | 3.0 | 950°C/AC | 450°C/AC |
| Comp. Ex. 2 | 4.0 | 1060°C/AC | 880°C | 0.8 | 3.0 | - | - | - | 1000°C/AC | 635°C/AC |
| Comp. Ex. 3 | 4.0 | 1060°C/AC | 960°C | 0.05 | 3.0 | - | - | - | 1000°C/AC | 635°C/AC |
| Comp. Ex. 4 | 4.0 | 1060°C/AC | 960°C | 16.0 | 3.0 | - | - | - | 1000°C/AC | 635°C/AC |
| Comp. Ex. 5 | 4.0 | 1060°C/AC | 960°C | 2.4 | 1.6 | - | - | - | 1000°C/AC | 635°C/AC |
| Comp. Ex. 6 | 4.0 | 1060°C/AC | 960°C | 2.4 | 1.6 | 960°C | 5.9 | 3.0 | 1000°C/AC | 635°C/AC |
| Comp. Ex. 7 | 4.0 | 1060°C/AC | 960°C | 0.8 | 3.0 | - | - | - | 1050°C/AC | 635°C/AC |
| Comp. Ex. 8 | 4.0 | 1060°C/AC | 960°C | 0.8 | 3.0 | - | - | - | 960°C/AC | 635°C/AC |
| Comp. Ex. 9 | 2.0 | 1060°C/AC | 960°C | 0.8 | 3.0 | - | - | - | 1000°C/AC | 635°C/AC |

*Fig. 5*

| | Equiaxed α grains | | | β grains | Creep | LCF |
|---|---|---|---|---|---|---|
| | Average grain diameter | Average aspect ratio | Sectional areal proportion | Average grain diameter | | |
| Example 1 | 18 μm | 3.2 | 20% | 78 μm | A | B |
| Example 2 | 10 μm | 3.2 | 6% | 221 μm | A | B |
| Example 3 | 8 μm | 1.8 | 32% | 8 μm | B | A |
| Example 4 | 12 μm | 1.8 | 28% | 28 μm | A | A |
| Example 5 | 15 μm | 2.8 | 21% | 85 μm | A | A |
| Example 6 | 12 μm | 1.2 | 22% | 47 μm | A | A |
| Example 7 | 13 μm | 1.9 | 21% | 45 μm | A | A |
| Example 8 | 7 μm | 1.7 | 22% | 15 μm | B | A |
| Example 9 | 12 μm | 2.0 | 28% | 46 μm | A | A |
| Example 10 | 13 μm | 1.4 | 24% | 30 μm | A | A |
| Comparative Example 1 | 17 μm | 2.0 | 28% | 35 μm | C | C |
| Comparative Example 2 | 2.8 μm | 1.8 | 27% | 3.3 μm | C | A |
| Comparative Example 3 | 28 μm | 6.2 | 26% | 148 μm | A | C |
| Comparative Example 4 | 3.8 μm | 1.9 | 28% | 8 μm | C | A |
| Comparative Example 5 | 18 μm | 7.8 | 19% | 59 μm | B | C |
| Comparative Example 6 | 17 μm | 6.3 | 20% | 68 μm | B | C |
| Comparative Example 7 | - | - | - | 687 μm | A | C |
| Comparative Example 8 | 18 μm | 3.2 | 38% | 28 μm | C | A |
| Comparative Example 9 | 22 μm | 7.1 | 18% | 46 μm | B | C |

· Creep: evaluated in terms of strain amount.
A, less than 0.5%; B, 0.5-2.0%; C, larger than 2.0%

· Low cycle fatigue (LCF): evaluated in terms of the number of repetitions to rupture.
A, more than 10,000; B, 5,000-10,000; C, less than 5,000

EXAMPLE 1 50μm

COMPARATIVE EXAMPLE 4 50μm

HEAT-RESISTANT TI ALLOY AND PROCESS FOR PRODUCING THE SAME

FIELD OF THE INVENTION

The present invention relates to a heat-resistant Ti alloy having excellent high-temperature strength and a process for producing the same. More particularly, the present invention relates to a heat-resistant Ti alloy having a composite structure having an equiaxed α phase and β grains containing an acicular α phase inside thereof, and a process for producing the same.

BACKGROUND OF THE INVENTION

Titanium (Ti) has a melting point of 1,600° C. or higher, which is far higher than those of aluminum (Al) and magnesium (Mg), which are likewise classified as light metals. Furthermore, at 885° C., which is a β-transus (transformation point), titanium undergoes an allotropic transformation in which the crystal structure changes from the close-packed cubic system (α phase) to the body-centered cubic system (β phase). These properties are utilized to develop Ti alloys.

Many heat-resistant Ti alloys contain Al, which is an element for stabilizing the α phase, which has excellent high-temperature strength, and the mechanism of solid-solution strengthening by Sn or Zr is utilized therein. Representative alloys include a Ti-6Al-2Sn-4Zr-2Mo-0.1Si (Ti-6-2-4-2S) alloy, which is used as members for airplane engines. This alloy is regarded as combining high mechanical strength and creep resistance even at temperatures around 750 K.

For example, Patent Document 1 discloses, for Ti-6-2-4-2S alloy, a method of adjusting the grain sizes of the metallographic structure which are capable of affecting the mechanical strength by changing conditions for heat treatments and forging. Specifically, the patent document first discloses that a work is processed in accordance with specification of AMS4976, namely, a work is hot-worked at a temperature which is in an (α+β)-two-phase temperature region and is close to a β-transus, and is then heat-treated at a temperature lower than the β-transus by several tens of degrees centigrade to perform an aging treatment, thereby obtaining a heat-resistant Ti alloy having a composite structure including a β phase in which an acicular α phase and an equiaxed α phase have been formed (see the description in paragraph [0133] and FIG. 11(*a*)). In addition, the patent document discloses a method in which an alloy having a β-transus of, for example, 996° C. is subjected to β annealing at a temperature higher than the β-transus and is then subjected to hot working at a temperature that is in an (α+β)-two-phase temperature region and is lower than the β-transus by 56-388° C. and at a given strain rate, thereby enabling the acicular α phase and the equiaxed α phase to be formed more thinly (see the description in paragraph [0134] and FIG. 11(*b*)).

Meanwhile, Patent Document 2 discloses an improved material of a Ti-6-2-4-2S alloy, and discloses that the amount of an equiaxed α phase obtained by hot forming is adjusted by performing a solution heat treatment, thereby enabling the improved material to combine fatigue strength and creep strength at high temperatures. Specifically, a bulk alloy having a given composition is held in a β-single-phase temperature region, rapidly cooled to 700° C. or lower by air cooling or at a rate not lower than that in air cooling, and then gradually cooled by air cooling or at a rate not higher than that in air cooling. Subsequently, the alloy is hot-formed in an (α+β)-two-phase temperature region and thereafter subjected to a solution heat treatment and then to an aging heat treatment. In particular, the patent document discloses that the hot forming is performed so as to result in a forming ratio of 3 or higher to obtain an equiaxed α phase in a sufficient amount. The patent document discloses that, in general, the creep strength can be enhanced by adjusting the holding temperature in the solution heat treatment to a temperature in a β-single-phase temperature region to reduce the amount of the equiaxed α phase, while the fatigue strength can be enhanced by adjusting the holding temperature to a temperature in an (α+β)-two-phase temperature region to increase the amount of the equiaxed α phase.

Patent Document 1: JP-T-2016-503126

Patent Document 2: JP-A-10-195563

SUMMARY OF THE INVENTION

As disclosed in Patent Document 2, in heat-resistant Ti alloys having a composite structure including an α phase and a β phase, there generally is a trade-off relationship between the creep strength and the high-temperature fatigue strength and, hence, sufficient heat resistance cannot be obtained by merely controlling the amount of the equiaxed α phase.

The present invention has been achieved under such circumstances, and an object thereof is to provide a heat-resistant Ti alloy having sufficient high-temperature strength and excellent producibility and a process for producing the heat-resistant Ti alloy.

A heat-resistant Ti alloy of the present invention is a heat-resistant Ti alloy having an excellent high-temperature strength and having a composition including, in terms of % by mass:

5.0-7.0% of Al;
3.0-5.0% of Sn;
2.5-6.0% of Zr;
2.0-4.0% of Mo;
0.05-0.80% of Si;
0.001-0.200% of C;
0.05-0.20% of O; and
0.3-2.0% in total of at least one kind selected from the group consisting of Nb and Ta;

with the balance being Ti and unavoidable impurities, in which the heat-resistant Ti alloy has a composite structure having an equiaxed α phase and β grains containing an acicular α phase inside thereof, and the equiaxed α phase has an average grain diameter of 5 μm to 20 μm and an average aspect ratio of 5.0 or less, and is contained in an amount of 5-35% in terms of sectional areal proportion to the composite structure.

According to the present invention, not only the shape and amount of an equiaxed α phase but also the form of an acicular α phase present in β grains are controlled, thereby imparting sufficient high-temperature strength. In particular, the form of the acicular α phase in the β grains can be easily controlled by adjusting the conditions for heat treatments and forging, and the heat-resistant Ti alloy hence has excellent producibility.

In the present invention described above, the β grains may have an average grain diameter of 10 μm to 200 μm. According to the invention, a composite structure is obtained in which the average grain diameter of the β grains has also been controlled, and sufficient high-temperature strength can be obtained.

In the present invention described above, the composition may further include, in terms of % by mass: 0.005-0.200% of B. According to the invention, B contained contributes to a reduction in size of the crystal grains and, hence, sufficient high-temperature strength can be obtained.

In the present invention described above, in the composition, a content of N may be limited to 0.2% by mass or less, and a content of Fe may be limited to 0.2% by mass or less. According to the invention, embrittlement is inhibited, and sufficient high-temperature strength can be obtained.

Additionally, a process for producing a heat-resistant Ti alloy according to the present invention is a process for producing a heat-resistant Ti alloy having an excellent high-temperature strength and having a composite structure having an equiaxed α phase and β grains containing an acicular α phase inside thereof, the process including:

a step of preparing a bulk alloy having a composition including, in terms of % by mass:

5.0-7.0% of Al;

3.0-5.0% of Sn;

2.5-6.0% of Zr;

2.0-4.0% of Mo;

0.05-0.80% of Si;

0.001-0.200% of C;

0.05-0.20% of O; and 0.3-2.0% in total of at least one kind selected from the group consisting of Nb and Ta;

with the balance being Ti and unavoidable impurities, a first heat treatment step in which the alloy is heated and held at a temperature that is within a β-single-phase temperature region and is higher than a β transformation point $T_\beta$, an adjustment forging step in which the alloy is hot-forged at a temperature that is within an (α+β)-two-phase temperature region and is lower than the β transformation point $T_\beta$, thereby adjusting an equiaxed α phase, a second heat treatment step in which the alloy is heated and held at a temperature that is within the (α+β)-two-phase temperature region and is higher than the temperature in the adjustment forging step, followed by cooling to precipitate an acicular α phase, and an aging heat treatment step which is performed at 570-650° C., in which, prior to the first heat treatment step, the alloy is subjected to a pre-forging step in which the alloy is hot-forged in the β-single-phase temperature region and further hot-forged in the (α+β)-two-phase temperature region, whereby the acicular α phase is formed in the β-grains, and the equiaxed α phase has an average grain diameter of 5 μm to 20 μm and an average aspect ratio of 5.0 or less and is contained in an amount of 5-35% in terms of sectional areal proportion to the composite structure.

According to the present invention, not only the shape and amount of an equiaxed α phase but also the form of an acicular α phase present in β grains are controlled, thereby imparting sufficient high-temperature strength. In particular, the form of the acicular α phase in the β grains can be easily controlled by adjusting the conditions for heat treatments and forging, and the heat-resistant Ti alloy can hence be highly efficiently produced.

In the present invention described above, the β grains may have an average grain diameter of 10 μm to 200 μm. According to the invention, higher high-temperature strength can be obtained.

In the present invention described above, the first heat treatment step may be a step in which the alloy is heated and held at a temperature that is within a β-single-phase temperature region of [$T_\beta$ to ($T_\beta$+80° C.)]. According to the invention, the heat treatment is conducted in the β-single-phase temperature region while maintaining the forging effect of the pre-forging step. Thus, high high-temperature strength can be reliably obtained.

In the present invention described above, in the first heat treatment step, the alloy may be held at a constant temperature and then gradually cooled at a cooling rate corresponding to or lower than in air cooling. According to the invention, cracking due to thermal stress is prevented while maintaining the composite structure described above. Thus, high high-temperature strength can be reliably obtained.

In the present invention described above, the pre-forging step may be a step in which the alloy is hot-forged in the β-single-phase temperature region and further hot-forged in an (α+β)-two-phase temperature region of [($T_\beta$−100° C.) to $T_\beta$] so as to result in a total forming ratio in the forging of 3 or higher. According to the invention, the shape of the equiaxed α phase is adjusted while controlling the grain diameter of, in particular, the β grains. Thus, high high-temperature strength can be reliably obtained.

In the present invention described above, the adjustment forging step may be a step in which the alloy is hot-forged at a strain rate of 0.1-10/sec in the (α+β)-two-phase temperature region of [($T_\beta$−100° C.) to $T_\beta$] so as to result in a total forming ratio in the forging of 3 or higher, and the second heat treatment step may be a step in which the alloy is held at a temperature in an (α+β)-two-phase temperature region of [($T_\beta$−50° C.) to $T_\beta$]. According to the invention, the grain diameter and aspect ratio of the equiaxed α phase can be more reliably adjusted while attaining a grain size reduction over the whole structure. Thus, high high-temperature strength can be reliably obtained.

In the present invention described above, the process may further include, after the adjustment forging step, an upset forging step in which the alloy is subjected to hot upset forging at a strain rate of 0.1-10/sec in the (α+β)-two-phase temperature region of [($T_\beta$−100° C.) to $T_\beta$] so as to result in a total forming ratio in the upset forging of 3 or higher. According to the invention, the whole composite structure can be homogenized while maintaining the composite structure which has been controlled in the adjustment forging step. Thus, high high-temperature strength can be obtained.

In the present invention described above, the composition may further include, in terms of % by mass: 0.005-0.200% of B. According to the invention, the crystal grains are made finer. Thus, high high-temperature strength can be obtained.

BRIEF DESCRIPTION OF THE DRAWING

FIG. 3 is a table showing Ti-alloy compositions used in Examples according to the present invention and Comparative Examples.

FIG. 4 is a table showing production conditions used in the Examples according to the present invention and the Comparative Examples.

FIG. 5 is a table showing test results obtained in the Examples according to the present invention and the Comparative Examples.

DETAILED DESCRIPTION OF THE INVENTION

Figure 1:
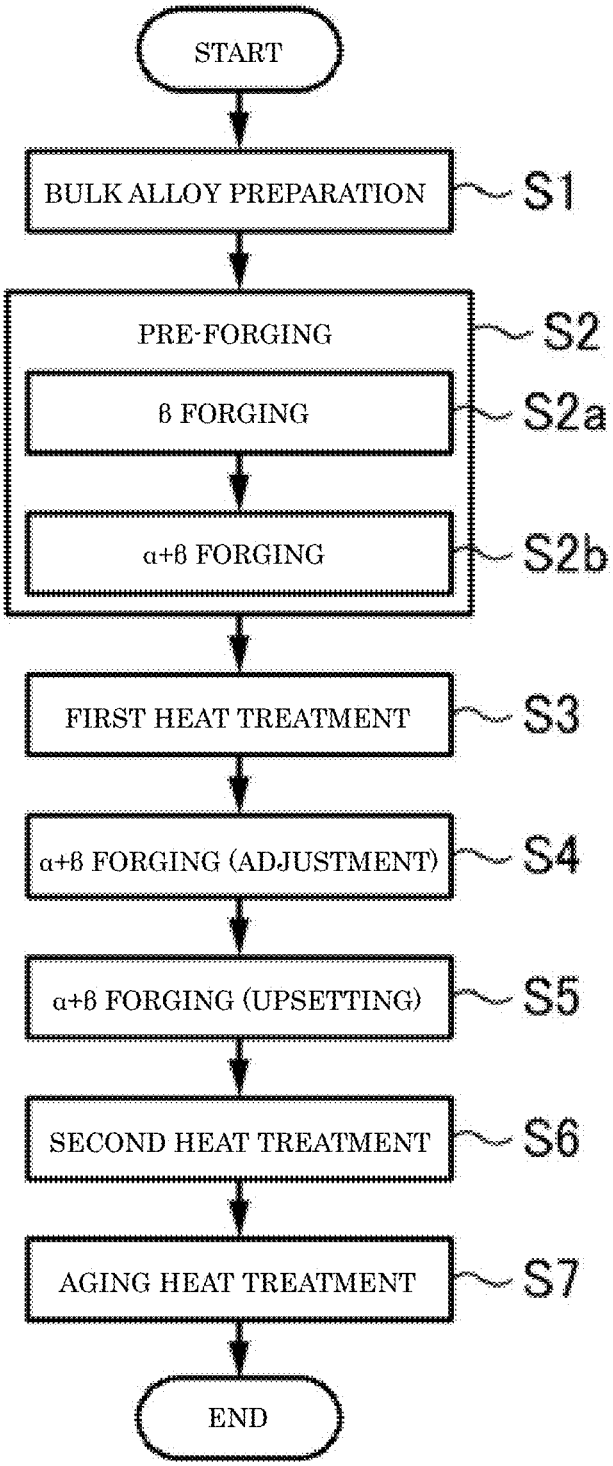
FIG. 1 is a flowchart which shows the steps of a process for producing a heat-resistant Ti alloy according to the present invention.
Figure 2:
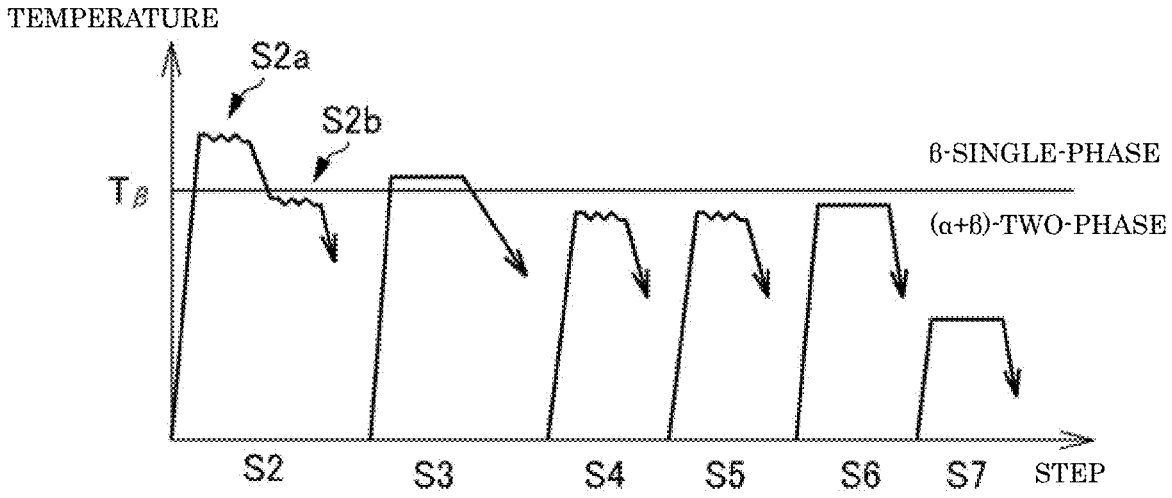
FIG. 2 is a heat-treatment diagram which illustrates the steps of the process for producing a heat-resistant Ti alloy according to the present invention.

As one embodiment according to the present invention, a process for producing a heat-resistant Ti alloy is explained using FIG. 1 and FIG. 2.

As shown in FIG. 1, a bulk alloy which is a Ti-5.8Al-4Sn-3.5Zr-2.8Mo-0.7Nb-0.35Si-0.06C alloy is prepared first (S1). Specifically, the bulk alloy is one constituted of a heat-resistant Ti alloy having a composition including, in terms of % by mass, 5.0-7.0% of Al, 3.0-5.0% of Sn, 2.5-6.0% of Zr, 2.0-4.0% of Mo, 0.05-0.80% of Si, 0.001-0.200% of C, 0.05-0.20% of O, and 0.3-2.0% in total of at least one kind selected from the group consisting of Nb and Ta, with the balance being Ti and unavoidable impurities. This composition of the bulk alloy may further contain 0.005-0.200% by mass of B, and it is preferable that, in the composition, a content of N is limited to 0.2% by mass or less, and a content of Fe is limited to 0.2% by mass or less.

This process is explained while referring also to FIG. 2. Subsequently, the bulk alloy is pre-forged (S2). In the pre-forging, the bulk alloy is first forged at a temperature within a β-single-phase temperature region so as to divide the cast structure thereof (β forging: S2*a*), and this alloy is immediately cooled to a temperature within an (α+β)-two-phase temperature region and forged so as to reduce the grain sizes of the structure (α+β forging: S2*b*). With respect to the forging temperature in this α+β forging S2*b*, it is preferable that the forging temperature is relatively high in the (α+β)-two-phase temperature region, from the standpoint of reducing the grain sizes of the alloy structure. More specifically, when the β transformation point is expressed by $T_\beta$, the forging temperature is preferably a temperature which is lower than $T_\beta$ but not lower than ($T_\beta$−100° C.). From the standpoint of operation conditions, it is desirable to employ a temperature of ($T_\beta$−10° C.) or lower in order to forge the alloy at a temperature which is lower than the β transformation point $T_\beta$ without fail. From the standpoint of reducing the grain sizes of the alloy structure, the total forming ratio in the pre-forging S2 (S2*a* and S2*b*) is adjusted to 3 or higher. When dividing the cast structure, this dividing is conducted by the β forging S2*a* in which the forging temperature is high and the deformation resistance is relatively low.

Subsequently, the alloy is heated and held at a temperature which is within the β-single-phase temperature region and is higher than the β transformation point $T_\beta$ (first heat treatment: S3). In this step, it is preferable that the alloy is held at a lower temperature within the β-single-phase temperature region in order to homogenize the alloy structure and simultaneously maintain the forging effect of the pre-forging (S2) by inhibiting the crystal grains from coarsening. More specifically, it is preferred to employ a temperature of ($T_\beta$+80° C.) or lower. From the standpoint of operation conditions, it is desirable to employ a temperature of ($T_\beta$+10° C.) or higher in order to hold the alloy at a temperature which is higher than the β transformation point $T_\beta$ without fail.

The cooling to be performed after the heating and holding in the first heat treatment S3 may be air cooling. However, from the standpoint of inhibiting the alloy from suffering cracking due to thermal stress, while controlling the form of an α phase which precipitates at the β-grain boundaries, it is preferred to gradually cool the alloy at a cooling rate corresponding to or lower than that in air cooling, for example, by air-cooling the alloy covered with a heat-insulating material.

Subsequently, the alloy is forged in the (α+β)-two-phase temperature region (α+β forging (adjustment): S4). Forging for reducing the grain sizes of the alloy structure and for adjusting the form of an equiaxed α phase is performed in this step. From the standpoint of reducing the grain sizes of the alloy structure, it is preferable that the forging temperature is relatively high in the (α+β)-two-phase temperature region. More specifically, the forging temperature is preferably a temperature which is lower than the β transformation point $T_\beta$ but not lower than ($T_\beta$−100° C.). From the standpoint of maintaining the forging effect of the α+β forging S2*b* of the pre-forging S2, it is preferred to employ a temperature which is the same as or lower than the forging temperature used in that forging. Furthermore, it is desirable to employ a temperature of ($T_\beta$−30° C.) or lower in order to forge the alloy at a temperature which is lower than the β transformation point $T_\beta$ without fail. From the standpoint of reducing the grain sizes of the alloy structure, the total forming ratio is adjusted to 3 or higher. In addition, the strain rate is adjusted to 0.1-10/sec to finally obtain an equiaxed α phase having an average grain diameter of 5 μm to 20 μm and an average aspect ratio of 5.0 or less. In case where the strain rate is too high, the finally obtained equiaxed α phase undesirably is too small. In case where the strain rate is too low, the equiaxed α phase undesirably has too large a grain diameter and too high an aspect ratio. A more preferred strain rate is 0.5-5.0/sec, with which it is possible to obtain an equiaxed α phase having an average grain diameter of 9 μm to 18 μm and an average aspect ratio of 3.0 or less.

The forged alloy may be further subjected, according to need, to upset forging in the (α+β)-two-phase temperature region (α+β forging (upsetting): S5), in the case where, for example, a disk shape is to be obtained. In this step, forging is conducted so that the alloy structure adjusted in the α+β forging (adjustment) S4 is homogenized and, simultaneously therewith, the alloy structure as a whole, in particular, the form of the equiaxed α phase, can be maintained. From the standpoint of maintaining the alloy structure, it is preferable that the forging temperature is the same as in the α+β forging (adjustment) S4 and is a temperature which is ($T_\beta$−100° C.) or higher but not higher than ($T_\beta$−30° C.). The strain rate is adjusted to 0.1-10/sec, and the total forming ratio is adjusted to 3 or higher.

After the α+β forging (adjustment) S4 or the α+β forging (upsetting) S5, the alloy is heated and held in the (α+β)-two-phase temperature region (second heat treatment: S6). The second heat treatment S6 is a so-called solution heat treatment. In this step, a holding temperature and a holding period are set so that, in particular, the equiaxed α phase comes to be present in a sectional areal proportion of 5-35% and preferably that the β grains containing an acicular α phase therein come to have an average grain diameter of 10 μm to 200 μm. The holding temperature is preferably ($T_\beta$−50° C.) or higher. From the standpoint of operation conditions, it is desirable to employ a temperature of ($T_\beta$−5° C.) or lower in order to hold the alloy at a temperature lower than the β transformation point $T_\beta$ without fail.

Finally, the alloy is heated and held at 570-650° C. to perform an aging heat treatment (S7). In this step, a balance between tensile strength and ductility is obtained.

The heat-resistant Ti alloy obtained by the production process described above has a composite structure including: β grains containing an acicular α phase inside thereof; and an equiaxed α phase. As described hereinabove, the equiaxed α phase has been made to have an average grain diameter of 5 μm to 20 μm and an average aspect ratio of 5.0 or less and contained in a sectional areal proportion to the composite structure of 5-35%. By obtaining such alloy structure, sufficient high-temperature strength can be obtained.

Heat-resistant Ti alloys produced by the production process described above were tested for high-temperature strength and examined for structure with a microscope, and the tests and the examination are explained next using FIG. 1 to FIG. 7.

Ti alloy materials respectively having the compositions of Examples 1 to 10 and Comparative Examples 1 to 9 shown in FIG. 3 were used to produce test materials under the respective sets of production conditions shown in FIG. 4. The term "AC" used for showing cooling conditions for each heat treatment indicates air cooling. With respect to all the Examples and Comparative Examples, the steps ranging from the bulk alloy preparation S1 to the α+β forging (adjustment) S4, in the production process described above (see FIG. 1 and FIG. 2), were conducted to produce billets each having a size of 196 mm (diameter)×600 mm (length). With respect to some (Example 6 and Comparative Examples 1 and 6) of these, the α+β forging (upsetting) S5 was further performed to produce disks each having a size of 400 mm (diameter)×140 mm (thickness). A square bar having a size of 20 mm×20 mm×100 mm was cut out from each of the billets and disks produced, and subjected to the second heat treatment S6 and the aging heat treatment S7 to obtain a test material. The β transformation points $T_\beta$ of the alloys of the Examples and Comparative Examples were 995° C. for Comparative Example 1 and 1,035° C. for all the others (see FIG. 3).

Test pieces necessary for the tests were cut out from the test materials, and were subjected to a creep test and a high-temperature low cycle fatigue test and to a microscopic structure examination. The results of the tests and examination are shown in FIG. 5.

In the creep test, each test piece was held under the conditions of a heating temperature of 600° C., imposed stress of 200 MPa, and holding period of 100 hours, and the strain amount was measured after the holding to evaluate the test piece. The case where the strain amount was less than 0.5% was rated as "A", the case where the strain amount was 0.5-2.0% was rated as "B", and the case where the strain amount exceeded 2.0% was rated as "C".

In the high-temperature low cycle fatigue test, a stress was repeatedly imposed to each test piece at a heating temperature of 450° C. so as to result in a total strain amount of 1.0%, and the test piece was evaluated in terms of the number of repetitions to a rupture. The case where the number of repetitions exceeded 10,000 was rated as "A", the case where the number thereof was 5,000-10,000 was rated as "B", and the case where the number thereof was less than 5,000 was rated as "C".

In the microscopic structure examination, the structure of a polished section of each test piece was examined with a microscope to determine the average grain diameter and average aspect ratio (average value of major axis/minor axis) of the equiaxed α phase and the sectional areal proportion thereof to the alloy structure. Furthermore, the average grain diameter of the β grains containing an acicular α phase therein was also determined.

As shown in FIG. 5, Examples 1 to 10 were each rated as "A" or "B" with respect to each of the creep test and the high-temperature low cycle fatigue test. Namely, excellent high-temperature strength was able to be obtained therein. In each of the Examples, the equiaxed α phase had an average grain diameter of 5 μm to 20 μm and an average aspect ratio of 5.0 or less and was contained in a sectional areal proportion to the composite structure in the range of 5-35%. The average grain diameter of the β grains in each of the Examples other than Examples 2 and 3 was in the range of 10 μm to 200 μm. In Example 2, since the solution heat treatment temperature (holding temperature in the second heat treatment S6) was as relatively high as 1,010° C. (see FIG. 4), the β grains had an average grain diameter as relatively large as 221 μm and, as a result, Example 2 was rated as "B" in the high-temperature low cycle fatigue test. Meanwhile, in Example 3, since the solution heat treatment temperature was as relatively low as 980° C. (see FIG. 4), the β grains had an average grain diameter as relatively small as 8 μm and, as a result, Example 3 was rated as "B" in the creep test.

Comparative Example 1 is a Ti alloy (Ti-6Al-4V alloy) considerably differing in composition from the Examples (see FIG. 3). Although the equiaxed α phase thereof was equal to those of the Examples in all of the average grain diameter, average aspect ratio, and sectional areal proportion, Comparative Example 1 was rated as "C" in both the creep test and the high-temperature low cycle fatigue test.

In Comparative Example 2, the forging temperature in the α+β forging (adjustment) S4 was 880° C., which is lower than the β transformation point $T_\beta$ (1,035° C.) by 155° C. The equiaxed α phase thereof had an average grain diameter as small as 2.8 μm, and the β grains thereof had an average grain diameter as small as 3.3 μm. As a result, Comparative Example 2 was rated as "C" in the creep test.

Comparative Examples 3 and 4 are ones in which the strain rate in the α+β forging (adjustment) S4 was low (0.05/sec) and high (16.0/sec), respectively. In Comparative Example 3, in which the strain rate was low, the equiaxed α phase had an average grain diameter as large as 28 μm and an aspect ratio as high as 6.2. As a result, Comparative Example 3 was rated as "C" in the high-temperature low cycle fatigue test. It is thought that grain size reduction in the equiaxed α phase did not proceed due to the low strain rate. Meanwhile, in Comparative Example 4, in which the strain rate was high, the equiaxed α phase had an average grain diameter as small as 3.8 μm and the β grains had an average grain diameter as small as 8 μm. As a result, Comparative Example 4 was rated as "C" in the creep test. It is thought that the grain sizes in the equiaxed α phase were excessively reduced due to the high strain rate.

Comparative Example 5 and Comparative Example 6 are ones in which the forming ratio in the α+β forging (adjustment) S4 was as low as 1.6, and the equiaxed α phases thereof had average aspect ratios as large as 7.8 and 6.3, respectively. As a result, Comparative Examples 5 and 6 were both rated as "C" in the high-temperature low cycle fatigue test. It is thought that in the α+β forging (adjustment) S4, the equiaxed α phase was unable to be sufficiently equiaxed. Although the α+β forging (upsetting) S5 was additionally performed in Comparative Example 6, it is thought that the alloy structure adjusted in the α+β forging (adjustment) S4 was maintained as a whole.

Comparative Examples 7 and 8 are ones in which the holding temperature in the second heat treatment S6 was high (1,050° C.) and low (960° C.), respectively. In Comparative Example 7, in which the holding temperature was high, since the holding temperature was higher than the β transformation point $T_\beta$ by 15° C. and was within the β-single-phase temperature region, no equiaxed α phase was observed and the β grains had been coarsened to an average grain diameter as large as 687 μm. Comparative Example 7 was rated as "C" in the high-temperature low cycle fatigue test. In Comparative Example 8, in which the holding temperature was low, the equiaxed α phase was contained in a sectional areal proportion as large as 38%. As a result, Comparative Example 8 was rated as "C" in the creep test.

In Comparative Example 9, the forming ratio in the pre-forging S2 was as low as 2.0, and it is thought that the influence of the alloy structure obtained by the pre-forging S2 remained. The equiaxed α phase thereof had an average aspect ratio as high as 7.1. As a result, Comparative Example 9 was rated as "C" in the high-temperature low cycle fatigue test.

Figure 6:
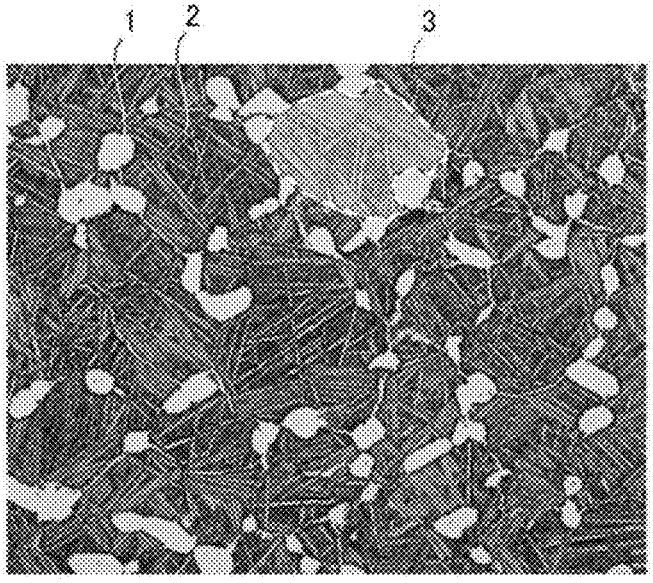
FIG. 6 is a photomicrograph of a polished section of Example 1.
Figure 7:
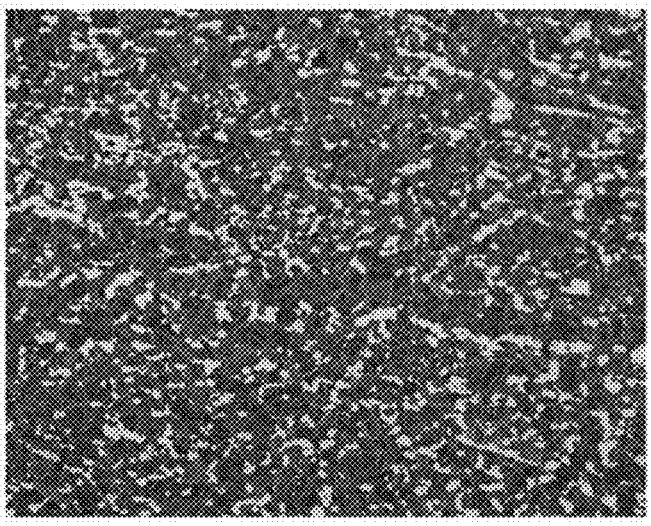
FIG. 7 is a photomicrograph of a polished section of Comparative Example 4.

Photomicrographs of Example 1 and Comparative Example 4 are shown respectively in FIG. 6 and FIG. 7 as representative examples in the microscopic structure examination.

As shown in FIG. 6, according to the alloy structure of Example 1, the β grain 3 surrounded by the broken line has an equiaxed α phase 1 at the grain boundaries thereof and contains an acicular α phase 2 therein, and the β grain 3 has been partitioned into a plurality of regions differing in the orientation and/or density of the acicular α phase 2. Namely, the composite structure described above was obtained.

Meanwhile, as shown in FIG. 7, it can be seen that in the alloy structure of Comparative Example 4, the equiaxed α phase and the β grains are both far smaller than those of Example 1. Because of this, the creep strength was low as described above.

It can be seen from the above results that in the Ti-5.8Al-4Sn-3.5Zr-2.8Mo-0.7Nb-0.35Si-0.06C alloy, sufficient high-temperature strength can be obtained by adjusting the average grain diameter and average aspect ratio of the equiaxed α phase, which indicate the form of the equiaxed α phase, and the sectional areal proportion thereof to the composite structure so as to be within the respective specific ranges. Furthermore, it is preferred to adjust the average grain diameter of the β grains so as to be within the specific range, as described above.

The ranges of the average grain diameter and average aspect ratio of the equiaxed α phase, the sectional areal proportion thereof to the composite structure, and the average grain diameter of the β grains are determined as follows, the ranges being for obtaining the same high-temperature strength as in the Examples given above.

The equiaxed α phase has the effect of inhibiting the growth of β grains in the solution heat treatment, i.e., the second heat treatment S6, and the diameter of the β grains can be adjusted by causing the equiaxed α phase to remain in an appropriate amount. In case where the equiaxed α phase has too small a grain diameter, not only the equiaxed α phase having a small grain diameter but also β grains having a reduced grain diameter result even when a solution heat treatment is conducted under the conditions described above to obtain the sectional areal proportion shown above. As a result, the creep strength decreases. Meanwhile, in case where the equiaxed α phase has too large a grain diameter, these grains are prone to serve as starting points for rupture, resulting in a decrease in high-temperature low cycle fatigue strength. In view of these, the average grain diameter of the equiaxed α phase is in the range of 5 μm to 20 μm, preferably in the range of 9 μm to 18 μm.

The average aspect ratio is an average value of aspect ratios of the equiaxed α phase which are calculated using the expression (major axis)/(minor axis). As the average aspect ratio approaches 1, that is, as the degree in which this α phase has been equiaxed increases, the high-temperature strength becomes more stable. In heat-resistant Ti alloys having a composite structure having an equiaxed α phase and β grains containing an acicular α phase therein, voids are prone to be formed at the grain boundaries between the equiaxed α phase and the β grains, and a high average aspect ratio causes stress concentration at the grain boundaries to reduce the creep strength. In view of these, the average aspect ratio of the equiaxed α phase is 5.0 or less, preferably 3.0 or less.

The sectional areal proportion of the equiaxed α phase to the composite structure is adjusted mainly by adjusting the holding temperature in the solution heat treatment (second heat treatment S6), and a balance between the creep strength and the high-temperature low cycle fatigue strength can be adjusted thereby. In case where the sectional areal proportion thereof is too small, β grains grow excessively in the solution heat treatment to reduce the high-temperature low cycle fatigue strength. Meanwhile, in case where the sectional areal proportion thereof is too large, the β grains have a reduced grain diameter to reduce the creep strength. In view of these, the sectional areal proportion of the equiaxed α phase to the composite structure is in the range of 5-35%, preferably in the range of 8-25%.

Incidentally, the equiaxed α phase is attributable to an acicular α phase precipitated in the heat treatment performed after the forging conducted in the (α+β)-two-phase temperature region so as to give a sufficient forming ratio. That acicular α phase is divided by the succeeding forging and deformed thereby or otherwise. That acicular α phase present at the β grain boundaries is deformed by a heat treatment. Namely, the precipitation behavior of the α phase can be controlled by adjusting production conditions such as the forging temperature, forming ratio, and strain rate in forging and the holding temperature and holding period in a heat treatment, as in the Examples given above. Thus, the form of an equiaxed α phase described above can be obtained.

As described above, the β grains have an equiaxed α phase at the grain boundaries thereof, and contain an acicular α phase therein, and have each been partitioned into a plurality of regions differing in the orientation and/or density of the acicular α phase. The β grains affect the creep strength; too small grain diameters thereof reduce the creep strength. Meanwhile, coarse β grains reduce the high-temperature low cycle fatigue strength. In view of these, the average grain diameter of the β grains is preferably in the range of 10 μm to –200 μm, more preferably in the range of 15 μm to 100 μm.

The grain diameter of the β grains is adjusted, to some degree, so as to be in the preferred range by adjusting the form of the equiaxed α phase. However, the diameter thereof can be adjusted so as to be in the preferred range by the solution heat treatment (second heat treatment S6), as in the Examples.

Meanwhile, the range of the content of each component of the alloy composition which gives high-temperature strength substantially equal to that of the heat-resistant Ti alloys including those of the Examples is determined as follows.

Al is an element which is effective mainly in strengthening the α phase to improve the high-temperature mechanical strength. However, excessive inclusion thereof undesirably yields $Ti_3Al$, which is an intermetallic compound, to reduce the room-temperature ductility. In view of these, the content of Al is in the range of 5.0-7.0% by mass.

Sn is an element which is effective in stabilizing both the α phase and the β phase and strengthening the α phase and the β phase while attaining a satisfactory balance therebetween, thereby improving the mechanical strength. However, excessive inclusion thereof tends to promote the formation of intermetallic compounds, e.g., $Ti_3Al$, to reduce the room-temperature ductility. In view of these, the content of Sn is in the range of 3.0-5.0% by mass.

Zr is an element which is effective in stabilizing both the α phase and the β phase and strengthening the α phase and the β phase while attaining a satisfactory balance therebetween, thereby improving the mechanical strength. However, excessive inclusion thereof tends to promote the formation of intermetallic compounds, e.g., $Ti_3Al$, to reduce the room-temperature ductility. In view of these, the content of Zr is in the range of 2.5-6.0% by mass.

Mo is an element which is effective mainly in strengthening the β phase and improving quench hardenability in heat treatments. However, excessive inclusion thereof undesirably reduces the creep strength. In view of these, the content of Mo is in the range of 2.0-4.0% by mass.

Si is an element which is effective in forming silicides to strengthen the grain boundaries and improve the mechanical strength. However, excessive inclusion thereof undesirably results in an increase in hot-working deformation resistance, etc. to reduce the producibility. In view of these, the content of Si is in the range of 0.05-0.80% by mass.

C is an element which is effective in forming carbides to strengthen the grain boundaries and improve the mechanical strength. Furthermore, C enables the form of the equiaxed α phase to be easily controlled just around the β transformation point $T_\beta$. However, excessive inclusion thereof undesirably results in an increase in hot-working deformation resistance, etc. to reduce the producibility. In view of these, the content of C is in the range of 0.001-0.200% by mass.

Nb and Ta are elements which are effective mainly in strengthening the β phase. However, excessive inclusion thereof undesirably increases the specific gravity of the alloy. In view of these, the total content of at least one kind selected from the group consisting of Nb and Ta is in the range of 0.3-2.0% by mass.

Fe, Ni, and Cr can strengthen the β phase. However, excessive inclusion thereof undesirably results in the formation of an embrittled phase. In view of these, the content of each of Fe, Ni, and Cr is up to 0.2% by mass, preferably up to 0.1% by mass.

B can form a boride with Ti to make the crystal grains finer. However, excessive inclusion thereof results in the formation of coarse boride grains, which can serve as starting points for rupture. In view of these, B can be added according to need in an amount preferably in the range of 0.200% by mass or less, specifically, 0.005-0.200% by mass.

O and N can strengthen the α phase. However, excessive inclusion thereof undesirably embrittles the alloy. In view of these, the content of O is in the range of 0.05-0.20% by mass, and the content of N is up to 0.2% by mass.

Although representative Examples of the present invention were explained above, the invention should not be construed as being entirely limited to the Examples. A person skilled in the art will be able to find out various substitutes for or modifications of the Examples without departing from the scope of the invention.

The present application is based on Japanese patent application No. 2016-243851 filed on Dec. 15, 2016, and the contents of which are incorporated herein by reference.

DESCRIPTION OF REFERENCE NUMERALS AND SIGNS

1 Equiaxed α phase
2 Acicular α phase
3 β grain

What is claimed is:

1. A heat-resistant Ti alloy having a composition consisting of, in terms of % by mass:
5.0-7.0% of Al;
3.0-5.0% of Sn;
2.5-6.0% of Zr;
2.0-4.0% of Mo;
0.05-0.80% of Si;
0.001-0.200% of C;
0.05-0.20% of O; and
0.3-2.0% in total of at least one kind selected from the group consisting of Nb and Ta;
with the balance being Ti and unavoidable impurities,
wherein the heat-resistant Ti alloy has a composite structure having an equiaxed α phase and β grains containing an acicular α phase inside thereof, and
the equiaxed α phase has an average grain diameter of 5 μm to 20 μm and an average aspect ratio of 5.0 or less, and is contained in an amount of 5-35% in terms of sectional areal proportion to the composite structure.

2. The heat-resistant Ti alloy according to claim 1, wherein the β grains have an average grain diameter of 10 μm to 200 μm.

3. A heat-resistant Ti alloy having a composition consisting of, in terms of % by mass:
5.0-7.0% of Al;
3.0-5.0% of Sn;
2.5-6.0% of Zr;
2.0-4.0% of Mo;
0.05-0.80% of Si;
0.001-0.200% of C;
0.05-0.20% of O;
0.3-2.0% in total of at least one kind selected from the group consisting of Nb and Ta; and
at least one selected from the group consisting of:
0.005-0.200% of B;
0.2% or less of N;
0.2% or less of Fe;
0.2% or less of Ni; and
0.2% or less of Cr,
with the balance being Ti and unavoidable impurities,
wherein the heat-resistant Ti alloy has a composite structure having an equiaxed α phase and β grains containing an acicular α phase inside thereof, and
the equiaxed α phase has an average grain diameter of 5 μm to 20 μm and an average aspect ratio of 5.0 or less, and is contained in an amount of 5-35% in terms of sectional areal proportion to the composite structure.

4. The heat-resistant Ti alloy according to claim 3, wherein the β grains have an average grain diameter of 10 μm to 200 μm.

5. A process for producing a heat-resistant Ti alloy having a composite structure having an equiaxed α phase and β grains containing an acicular α phase inside thereof, the process comprising:
a step of preparing a bulk alloy having a composition consisting of, in terms of % by mass:
5.0-7.0% of Al;
3.0-5.0% of Sn;
2.5-6.0% of Zr;
2.0-4.0% of Mo;
0.05-0.80% of Si;
0.001-0.200% of C;
0.05-0.20% of O; and
0.3-2.0% in total of at least one kind selected from the group consisting of Nb and Ta;

with the balance being Ti and unavoidable impurities, a first heat treatment step in which the alloy is heated and held at a temperature that is within a β-single-phase temperature region and is higher than a β transformation point $T_\beta$, an adjustment forging step in which the alloy is hot-forged at a temperature that is within an (α+β)-two-phase temperature region and is lower than the β transformation point $T_\beta$, thereby adjusting an equiaxed α phase, a second heat treatment step in which the alloy is heated and held at a temperature that is within the (α+β)-two-phase temperature region and is higher than the temperature in the adjustment forging step, followed by cooling to precipitate an acicular α phase, and an aging heat treatment step which is performed at 570-650° C., wherein, prior to the first heat treatment step, the alloy is subjected to a pre-forging step in which the alloy is hot-forged in the β-single-phase temperature region and further hot-forged in the (α+β)-two-phase temperature region, whereby the acicular α phase is formed in the β-grains, and the equiaxed α phase has an average grain diameter of 5 μm to 20 μm and an average aspect ratio of 5.0 or less and is contained in an amount of 5-35% in terms of sectional areal proportion to the composite structure.

6. The process for producing a heat-resistant Ti alloy according to claim 5, wherein the β grains have an average grain diameter of 10 μm to 200 μm.

7. The process for producing a heat-resistant Ti alloy according to claim 5, wherein the first heat treatment step is a step in which the alloy is heated and held at a temperature that is within a β-single-phase temperature region of [higher than $T_\beta$ and ($T_\beta$+80° C.) or lower].

8. The process for producing a heat-resistant Ti alloy according to claim 7, wherein, in the first heat treatment step, the alloy is held at a constant temperature and then gradually cooled at a cooling rate corresponding to or lower than in air cooling.

9. The process for producing a heat-resistant Ti alloy according to claim 5, wherein the pre-forging step is a step in which the alloy is hot-forged in the β-single-phase temperature region and further hot-forged in an (α+β)-two-phase temperature region of [(β−100° C.) or higher and lower than $T_\beta$] so as to result in a total forming ratio in the forging of 3 or higher.

10. The process for producing a heat-resistant Ti alloy according to claim 9, wherein the adjustment forging step is a step in which the alloy is hot-forged at a strain rate of 0.1-10/sec in the (α+β)-two-phase temperature region of [($T_\beta$−100° C.) or higher and lower than $T_\beta$] so as to result in a total forming ratio in the forging of 3 or higher, and the second heat treatment step is a step in which the alloy is held at a temperature in an (α+β)-two-phase temperature region of [($T_\beta$−50° C.) or higher and lower than $T_\beta$].

11. The process for producing a heat-resistant Ti alloy according to claim 10, further including, after the adjustment forging step, an upset forging step in which the alloy is subjected to hot upset forging at a strain rate of 0.1-10/sec in the (α+β)-two-phase temperature region of [($T_\beta$−100° C.) to ($T_\beta$−30° C.)] so as to result in a total forming ratio in the upset forging of 3 or higher.

12. A process for producing a heat-resistant Ti alloy having a composite structure having an equiaxed α phase and β grains containing an acicular α phase inside thereof, the process comprising:

a step of preparing a bulk alloy having a composition consisting of, in terms of % by mass:

5.0-7.0% of Al;
3.0-5.0% of Sn;
2.5-6.0% of Zr;
2.0-4.0% of Mo;
0.05-0.80% of Si;
0.001-0.200% of C;
0.05-0.20% of O;
0.3-2.0% in total of at least one kind selected from the group consisting of Nb and Ta; and at least one selected from the group consisting of:

0.005-0.200% of B;
0.2% or less of N;
0.2% or less of Fe;
0.2% or less of Ni; and
0.2% or less of Cr, with the balance being Ti and unavoidable impurities, a first heat treatment step in which the alloy is heated and held at a temperature that is within a β-single-phase temperature region and is higher than a β transformation point $T_\beta$, an adjustment forging step in which the alloy is hot-forged at a temperature that is within an (α+β)-two-phase temperature region and is lower than the β transformation point $T_\beta$, thereby adjusting an equiaxed α phase, a second heat treatment step in which the alloy is heated and held at a temperature that is within the (α+β)-two-phase temperature region and is higher than the temperature in the adjustment forging step, followed by cooling to precipitate an acicular α phase, and an aging heat treatment step which is performed at 570-650° C., wherein, prior to the first heat treatment step, the alloy is subjected to a pre-forging step in which the alloy is hot-forged in the β-single-phase temperature region and further hot-forged in the (α+β)-two-phase temperature region, whereby the acicular α phase is formed in the β-grains, and the equiaxed α phase has an average grain diameter of 5 μm to 20 μm and an average aspect ratio of 5.0 or less and is contained in an amount of 5-35% in terms of sectional areal proportion to the composite structure.

13. The process for producing a heat-resistant Ti alloy according to claim 12, wherein the β grains have an average grain diameter of 10 μm to 200 μm.

14. The process for producing a heat-resistant Ti alloy according to claim 12, wherein the first heat treatment step is a step in which the alloy is heated and held at a temperature that is within a β-single-phase temperature region of [higher than $T_\beta$ and ($T_\beta$+80° C.) or lower].

15. The process for producing a heat-resistant Ti alloy according to claim 14, wherein, in the first heat treatment step, the alloy is held at a constant temperature and then gradually cooled at a cooling rate corresponding to or lower than in air cooling.

16. The process for producing a heat-resistant Ti alloy according to claim 12, wherein the pre-forging step is a step in which the alloy is hot-forged in the β-single-phase temperature region and further hot-forged in an (α+β)-two-phase temperature region of [($T_\beta$−100° C.) or higher and lower than $T_\beta$] so as to result in a total forming ratio in the forging of 3 or higher.

17. The process for producing a heat-resistant Ti alloy according to claim 16, wherein the adjustment forging step is a step in which the alloy is hot-forged at a strain rate of 0.1-10/sec in the (α+β)-two-phase temperature region of

[($T_\beta$−100° C.) or higher and lower than $T_\beta$] so as to result in a total forming ratio in the forging of 3 or higher, and the second heat treatment step is a step in which the alloy is held at a temperature in an (α+β)-two-phase temperature region of [($T_\beta$−50° C.) or higher and lower than $T_\beta$].

18. The process for producing a heat-resistant Ti alloy according to claim 17, further including, after the adjustment forging step, an upset forging step in which the alloy is subjected to hot upset forging at a strain rate of 0.1-10/sec in the (α+β)-two-phase temperature region of [($T_\beta$−100° C.) to ($T_\beta$−30° C.)] so as to result in a total forming ratio in the upset forging of 3 or higher.

* * * * *